US007815850B2

(12) United States Patent
Baker et al.

(10) Patent No.: US 7,815,850 B2
(45) Date of Patent: Oct. 19, 2010

(54) HIGH-STRENGTH NANOSTRUCTURED ALLOYS

(75) Inventors: Ian Baker, Etna, NH (US); Markus Wolfgang Wittmann, Quechee, VT (US); James Anthony Hanna, Hanover, NH (US)

(73) Assignee: The Trustees of Dartmouth College, Hanover, NH (US)

( * ) Notice: Subject to any disclaimer, the term of this patent is extended or adjusted under 35 U.S.C. 154(b) by 275 days.

(21) Appl. No.: 11/517,036

(22) Filed: Sep. 7, 2006

(65) Prior Publication Data

US 2007/0187010 A1 Aug. 16, 2007

Related U.S. Application Data

(63) Continuation-in-part of application No. PCT/US2005/007688, filed on Mar. 9, 2005.

(51) Int. Cl.
*C22C 30/00* (2006.01)

(52) U.S. Cl. ..... 420/581; 148/442

(58) Field of Classification Search ..... 148/442; 420/581

See application file for complete search history.

(56) References Cited

U.S. PATENT DOCUMENTS 4,642,145 A * 2/1987 Masumoto et al. ..... 148/336
2002/0124913 A1 9/2002 Uehara et al.

FOREIGN PATENT DOCUMENTS

JP 2001279360 A * 10/2001

OTHER PUBLICATIONS

Laughlin et al., Spinodal Structures, ASM Handbook,1992, ASM International, vol. 9, 9th Edition, p. 652-654.*
Ramanarayan and Abinandan, Spinodal decomposition in fine grained materials, Bltn. Matter. Sci. vol. 26, No. 1, 189-192 (Jan. 2003).
Mainville et al., X-ray scattering Study of Early Stage Spinodal Decomposition in AI0.62Zn0.38, Phys. Review Lett. vol. 78, No. 14, 2787-2790 (1977).
Srinivas, M. et al. A first report on tracture toughness of BCC iron alloys as influenced by solutes; opposite effects of silicon and cobalt, Bull. Mater. Sci., vol. 11 No. 4, Dec. 1988, pp. 328-329.
Spinodal Decomposition, IUPAC Compendium of Chemical Terminology, 2nd Edition (1997) pp. 1.
Misra, A. and Gibala, R., Room-Temperature Deformation Behavior of Directionally Solidified Multiphase Ni-Fe-Al Alloys, Metallurgical and Materials Transactions A., vol. 28A, Mar. 1997, pp. 795-807.
Misra, A., et al., Optimization of toughness and strength in multiphase intermetallics, Elsevier Intermetallics 9 (2001) pp. 971-978.

(Continued)

*Primary Examiner*—Roy King
*Assistant Examiner*—Caitlin Fogarty
(74) *Attorney, Agent, or Firm*—Lathrop & Gage LLP

(57) ABSTRACT

Biphasic alloys, formed through a spinodal decomposition process, are disclosed. The alloys have improved strength and hardness, over single phase alloys, due to coherency strain between the phases. They are prepared from readily available transition metals, and they can be used to make large, high-strength parts, for example, of types that cannot be made by extrusion, forging or cold working techniques.

9 Claims, 5 Drawing Sheets

OTHER PUBLICATIONS

Szymura, S. The Effect of Manganese on the Modification of Non-Metallic Inclusions and Magnetic Properties of Columnar Alnico 5 Permanent Magnets, Journal of Magnetism and Magnetic Materials 30 (1983) pp. 389-394.

Cahn, J.W., The 1967 Institute of Metals Lecture Spinodal Decomposition, Transactions of the Metallurgical Society of AIME vol. 242, Feb. 1968, pp. 166-180.

Singh, Jogender and Wayman, C.M.; "Age-Harding Characteristics Of A Martensitic Fe-Ni-Mn Alloy," Materials Science And Engineering, 94, p. 233-242, 1987.

Hao, Shi Ming; Ishida, K.; and Nishizawa, T.; "Role of Alloying Elements In Phase Decomposition In Alnico Magnet Alloys," Metallurgical Transactions A, Feb. 1985, vol. 16A, No. 2, p. 179-185, Feb. 1985.

Inoue, et al., "Microstructure and Mechanical Properties of Rapidly Quenched L20 and L20 + L12 Alloys in Ni-Al-Fe and Ni-Al-Co Systems," Journal of Materials Science 19 (1984), pp. 3097-3106.

International Search Report and Written Opinion from related PCT Patent Application PCT/US05/07688, dated Nov. 4, 2006, 10 pages.

* cited by examiner

HIGH-STRENGTH NANOSTRUCTURED ALLOYS

RELATED APPLICATIONS

This application is a continuation-in-part of PCT/US05/007688, filed Mar. 9, 2005, which claimed priority to U.S. patent application Ser. No. 10/796,675, filed Mar. 9, 2004 now abandoned, each of which is incorporated by reference herein.

GOVERNMENT INTERESTS

The United States Government has rights in this invention under Contract Nos. NIST-60NANB2DD12D and NSF-DMR0314209 between the National Institute of Standards and Technology (NIST), the National Science Foundation (NSF) and Dartmouth College.

BACKGROUND

1. Field of the Invention

This invention generally relates to novel alloys and methods of producing the alloys. More specifically, the alloys are high-strength nanostructured alloys.

2. Description of the Related Art

Basic research in the field of alloy materials seeks to find improved materials, such as those that are lighter, stronger, or less expensive to produce than conventional alloys. In other contexts, improved materials may have increased resistance to weather, chemicals, or friction, in an intended environment of use. Equipment that incorporates these new materials in component parts may have a longer service life, require less maintenance, or achieve an improved performance level. From a cost of manufacture standpoint, it is desirable for these new materials to be made from readily available and highly affordable natural resources.

One technique that may be used to produce an alloy with enhanced strength is spinodal decomposition. Spinodal decomposition processes are described, for example, in Ramanarayan and Abinandan, *Spinodal decomposition in fine grained materials*, Bltn. Matter. Sci. Vol. 26, No. 1, 189-192 (January 2003), and the transition phase kinetics of spinodal decomposition are described in Mainville et al., *X-ray scattering Study of Early Stage Spinodal Decomposition in* $Al_{0.62}Zn_{0.38}$, Phys. Review Lett. Vol. 78, No. 14, 2787-2790 (1977). The Toughmet™ Cu—Ni—Sn alloys that are commercially available from Brush Wellman of Lorain, Ohio are one example of spinodal alloys used for structural applications.

Spinodal Fe—Ni—Al (Alnico) systems were studied by S. M. Hao; K. Ishida; T. Nishizawa, "Role of Alloying Elements in Phase Decomposition in Alnico Magnet Alloys" Metall. Trans. A, 16(2), Feb. 1985, 179-185. To a base Fe—Ni—Al system a small amount (less than 5 at. %) of Cu, Ti, Mn, V, Cr, Si, Mo, or Nb was added. The microstructure, miscibility gap characteristics and magnetic properties of the resulting materials were determined. The authors concluded that the elements Mn, Nb, Cr, Mo, Si, and V were "estimated to be of little use in Alnico alloys" (p. 183, col. 2).

U.S. Patent Application Publication No. 2002/0124913 discloses another Alnico compound, Fe—Cr—Ni—Al, that resists oxidation and exhibits high strength. The alloy consists essentially of, by mass, 0.003 to 0.08% C, 0.03 to 2.0% Si, not more than 2.0% Mn, from 1.0 to 8.0% Ni, from 10.0 to 19.0% Cr, 1.5 to 8.0% Al, 0.05 to 1.0% Zr and the balance Fe.

Under certain conditions, an intermetallic composition, e.g., Ni—Al, precipitates in the ferrite matrix as a non-spinodal second phase.

To date, very few spinodal Alnico systems are known, and the presence of Mn in those that are known is considered detrimental to the properties of the final product.

SUMMARY

Alloys of the present disclosure address the problems outlined above and advance the art by providing alloys with exceptional strength or hardness over a wide temperature range.

In one embodiment, an intermetallic composition formed by spinodal decomposition in at least two distinct structural phases has an average composition comprising from 9% to 41% iron, 9% to 41% nickel, 9% to 41% manganese and 9% to 41% aluminum, wherein the composition is described in terms of atomic percentages.

In one embodiment, an intermetallic composition formed by spinodal decomposition in at least two distinct structural phases has an average composition according to the formula:

$$Fe_aNi_bMn_cAl_dM_e,$$

wherein (in atomic percent) a ranges from 9 to 41; b ranges from 9 to 41; c ranges from 9 to 41; d ranges from 9 to 41; e ranges from 0 to 5; and M is selected (i) from the group consisting of V, Cr, Co, Mo, Ru and combinations thereof or (ii) from the group consisting of C, B, Ti and combinations thereof.

In one embodiment, a method of producing an intermetallic composition includes: heating a mixture of metals, to create a homogenous solution, according to the formula:

$$Fe_aNi_bMn_cAl_dM_e,$$

wherein (in atomic percent) a ranges from 9 to 41; b ranges from 9 to 41; c ranges from 9 to 41; d ranges from 9 to 41; e ranges from 0 to 5; and M is selected (i) from the group consisting of V, Cr, Co, Mo, Ru and combinations thereof or (ii) from the group consisting of C, B, Ti and combinations thereof; cooling the homogenous solution to obtain a homogeneous solid; rapidly quenching the solid to room temperature; reheating the solid to within a spinodal temperature region; and holding the spinodal temperature for a period of time.

DETAILED DESCRIPTION

Figure 1:
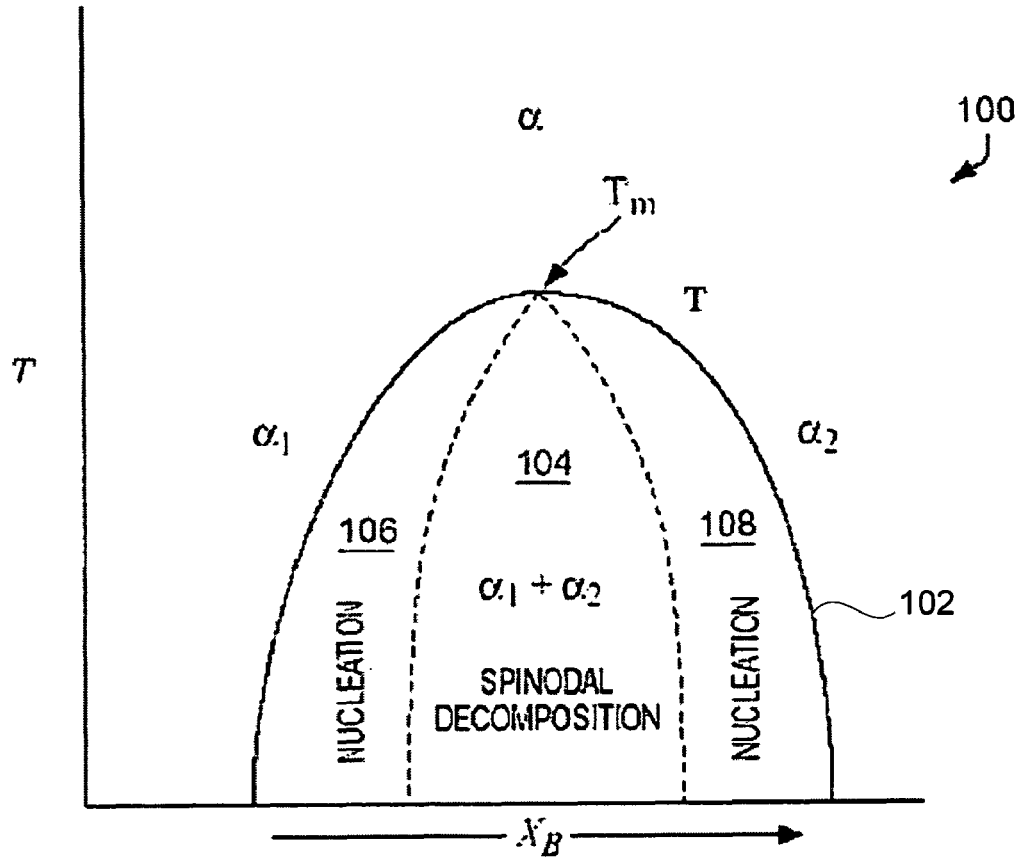
FIG. 1 is a phase diagram schematically illustrating one spinodal decomposition process.

The following definitions are provided to facilitate understanding of certain terms used frequently herein and are not meant to limit the scope of the present disclosure: The terms "alloy", "intermetallic compound", and "intermetallic compositions" are interchangeable. They refer to compounds containing at least two elements selected from metals and/or metalloids. "Ordered" refers to a uniform arrangement of atoms within a chemical structure.

The alloys disclosed herein may be incorporated into machine and industrial parts, and may be used to make large, high-strength parts that cannot be made by extrusion, forging or cold working techniques. Additionally, the alloys may be suitable for applications requiring high-strength, wear resistant parts including but not limited to: engines, bearings, bushings, stators, washers, seals, rotors, fasteners, stamping plates, dies, valves, punches, automobile parts, aircraft parts, and drilling and mining parts.

Materials described herein may demonstrate high impact strength, fatigue resistance, and toughness under harsh conditions. They may also have superior wear and corrosion resistance.

Alloy constituents may include a substantial amount of one or more elements selected from transitional metals and rare earth metals. In particular, the alloy contains iron, nickel, manganese, and aluminum to which may be added vanadium, chromium, cobalt, molybdenum, and ruthenium. This concept is represented by a macroscopic average formula:

$$Fe_aNi_bMn_cAl_dM_e, \quad \text{Formula (1)}$$

wherein M is an alloying addition of any element or combination of elements;

a ranges from 9 to 41 (atomic percent basis);

b ranges from 9 to 41;

c ranges from 9 to 41;

d ranges from 9 to 41, and e ranges from 0 to 5.

In one aspect, M may be a metal or combination of metals. For example, M may be vanadium, chromium, cobalt, molybdenum, ruthenium and combinations thereof. In another aspect, M may contain carbon, boron and other materials, such as where M is selected from carbon, boron, titanium and combinations thereof. In some embodiments, the portion of the alloy that is allocated to M may also range from 0.1 to 4% or in other aspects from 1% to 3%.

A narrower formulation that is within the general scope of formula (1) is:

$$Fe_xNi_{50-x}Mn_yAl_{50-y}, \quad \text{Formula (2)}$$

wherein X ranges from 9 to 41 (atomic percent basis), and Y ranges from 9 to 41.

Another aspect of the alloy may be a heat treatment process that results in spinodal decomposition leaving at least two intermetallic phases of different structure and stoichiometry. Thus, the macroscopic formula above pertains to the overall composition, but the macroscopic composition has nanostructure or microstructure of localized phase variances in composition and ordering. Generally, growth processes that result in lattice phase separations may derive from two mechanisms—nucleation or spinodal. In nucleation, nuclei form and lattice growth occurs on the individual nuclei. An energy barrier must be met to drive the growth. The lattice phases are well defined, such that a lattice structure arises from a matrix which may be amorphous. Another mechanism, that of spinodal decomposition, is a spontaneous clustering reaction that may occur in a homogeneous supersaturated solution, which may be a solid or liquid solution. The solution is unstable against infinitesimal fluctuations in density or composition, and so thermodynamics favor separation into two phases of differing composition and interconnected morphology. Lattice phase boundaries are diffuse and gradually become sharp. Spinodal decomposition of an alloy is possible when different metal atoms are of similar size; thus avoiding large scale diffusion which results in precipitation. The presence of two phases gives rise to large composition variations which cause coherency strains that strengthen the alloy.

As is known in the art, spinodal decomposition is a continuous diffusion process in which there is no nucleation step. A plurality of chemically different phases result from a migration of atoms, without the formation of precipitates. FIG. 1 is a phase diagram 100 showing one spinodal decomposition process that varies as a function of temperature T and intermetallic composition $X_B$. A homogenous composition or phase $\alpha$ exists at temperatures above $T_m$. An immiscibility dome 102 contains a spinodal decomposition region 104 that is flanked by nucleation zones 106, 108. At temperatures below $T_m$, phases $\alpha_1$ and $\alpha_2$ exist, each associated with an adjacent nucleation zone 106, 108, and these regions of FIG. 1 below $T_m$ are sometimes referred to as the "miscibility gap". The spinodal decomposition region 104 may be regarded as a stable or metastable region that contains both phases $\alpha_1$ and $\alpha_2$, and where atom migration is enabled by a miscibility difference between the phases $\alpha_1$ and $\alpha_2$. The structure of each phase $\alpha_1$, $\alpha_2$ within spinodal decomposition region 104 is usually continuous throughout the grains and continues up to the grain boundaries. The presence of two phases $\alpha_1$, $\alpha_2$, with corresponding composition variations, increases coherency strain thereby strengthening the material.

The alloys disclosed herein may be used under extreme conditions, for example, elevated temperatures and pressures or highly resistive conditions. Further, the alloys disclosed herein can be used in any known application currently utilizing a high-strength alloy.

In one aspect, alloys disclosed herein may comprise a coating. For example, suitable coatings may be selected from polymeric coatings, silicon-based coatings, metal oxide coatings, gold, platinum, silver, carbon-based coatings, adhesives, and combinations thereof.

The following examples set forth preferred materials and methods for use in making the disclosed alloys. The examples teach by way of illustration, not by limitation, and so should not be interpreted as unduly narrow.

EXAMPLE 1

Preparation and Characterization of $Fe_{30}Ni_{20}Mn_{25}Al_{25}$

A quaternary alloy of $Fe_{30}Ni_{20}Mn_{25}Al_{25}$ composition was prepared by well known arc melting and casting techniques. A quantity of material including 24 g Fe, 17 g Ni, 22 g Mn, and 10 g Al was placed in a water-cooled copper mold and heated until molten using the arc melting technique. Ingots were flipped and melted a minimum of three times under argon to ensure mixing. Quenching was done by allowing the alloy to rapidly cool in the copper mold to a temperature of ~30° C. in approximately 10 minutes. In some embodiments, a 5% excess of Mn may be added to the starting materials because Mn accounts for the majority of weight loss during casting, which results from brittle sharding and evaporation.

Figure 2:
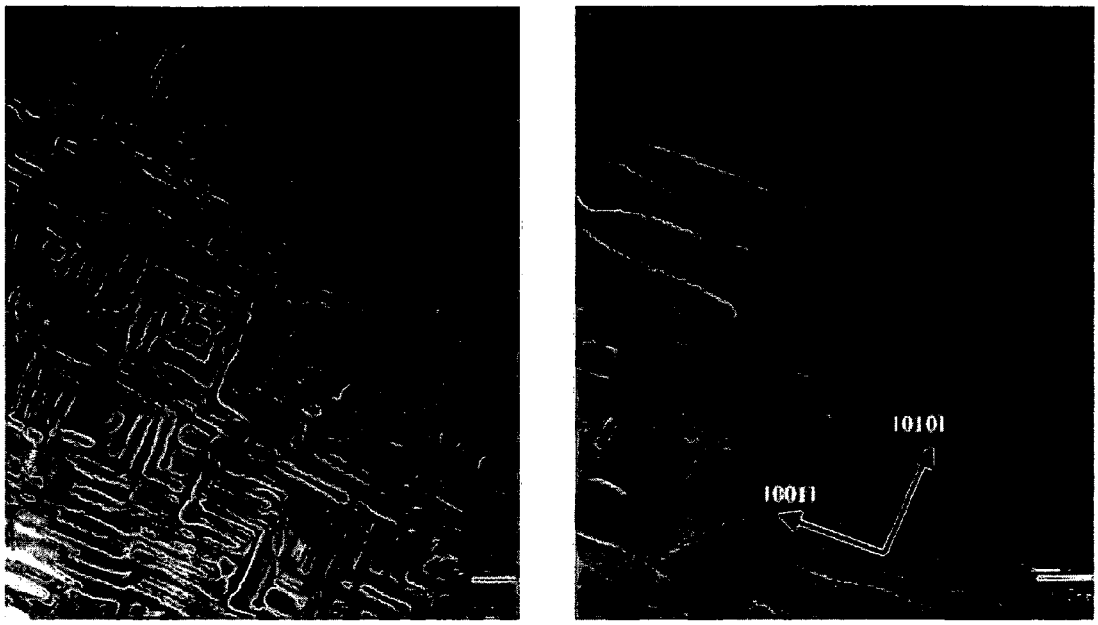
FIG. 2 is a transition electron micrograph of an exemplary intermetallic compound.

FIG. 2 is a TEM image of the resultant two phase alloy taken along the [100] axis. The alloy had nanostructure including 50-60 nm wide B2-structured plates that were spaced 40-50 nm apart. The B2 phase had a composition $Fe_3Ni_{34}Mn_{14}Al_{39}$. The plates were separated by a matrix material. The plates lie along axis [100] and have faces [010] that are consistent with a body centered cubic (b.c.c.) matrix having a composition $Fe_{49}Ni_2Mn_{30}Al_{19}$. The nanostructure appears to have developed through spinodal decomposition in which either the B2 structure formed at high temperatures and the b.c.c. second phase formed spinodally upon cooling, or the b.c.c. structure formed at high temperatures and the B2 phase formed spinodally at lower temperatures. Due to the significant composition differences between the phases there is a large coherency strain, which gives rise to a very strong alloy.

The alloy was characterized using analytical techniques that are well known in the art. Chemical composition was determined by energy dispersive spectroscopy (EDS). Table 1 reports the composition data for the respective b.c.c. and B2 phases. Structural data was obtained using a Siemens D5000 Diffractometer with a Kevex PSI silicon detector in the range of 10-130° 2θ, using an instrument that was calibrated against an alumina standard purchased from the National Institute of Standards (NIST). Transmission electron microscopy (TEM) was performed on either a JEOL 2000FX or a Philips CM 200, see FIG. 2.

Room temperature hardness of the two phase alloy was determined by taking the average of five measurements from a Leitz Microhardness indentor with a 200 g load. Results are given in Table 2.

TABLE 1

Chemical composition of the phases in $Fe_{30}Ni_{20}Mn_{25}Al_{25}$ as determined by EDS

| Phase/Element (atomic %) | Fe | Ni | Mn | Al |
|---|---|---|---|---|
| Matrix (b.c.c.) | 49.1 ± 1.0 | 1.6 ± 0.15 | 30.0 ± 1.0 | 19.3 ± 1.4 |
| Plates (B2) | 12.7 ± 0.5 | 34.3 ± 0.8 | 13.9 ± 0.5 | 38.9 ± 0.9 |

TABLE 2

Composition and Hardness Measurements of Two Phase Alloy and Constituents

| Alloy Composition | Structure | Vicker's Hardness (VPN) |
|---|---|---|
| $Fe_{30}Ni_{20}Mn_{25}Al_{25}$ | Two phase B2 and b.c.c. | 492 ± 14 |

Figure 3:
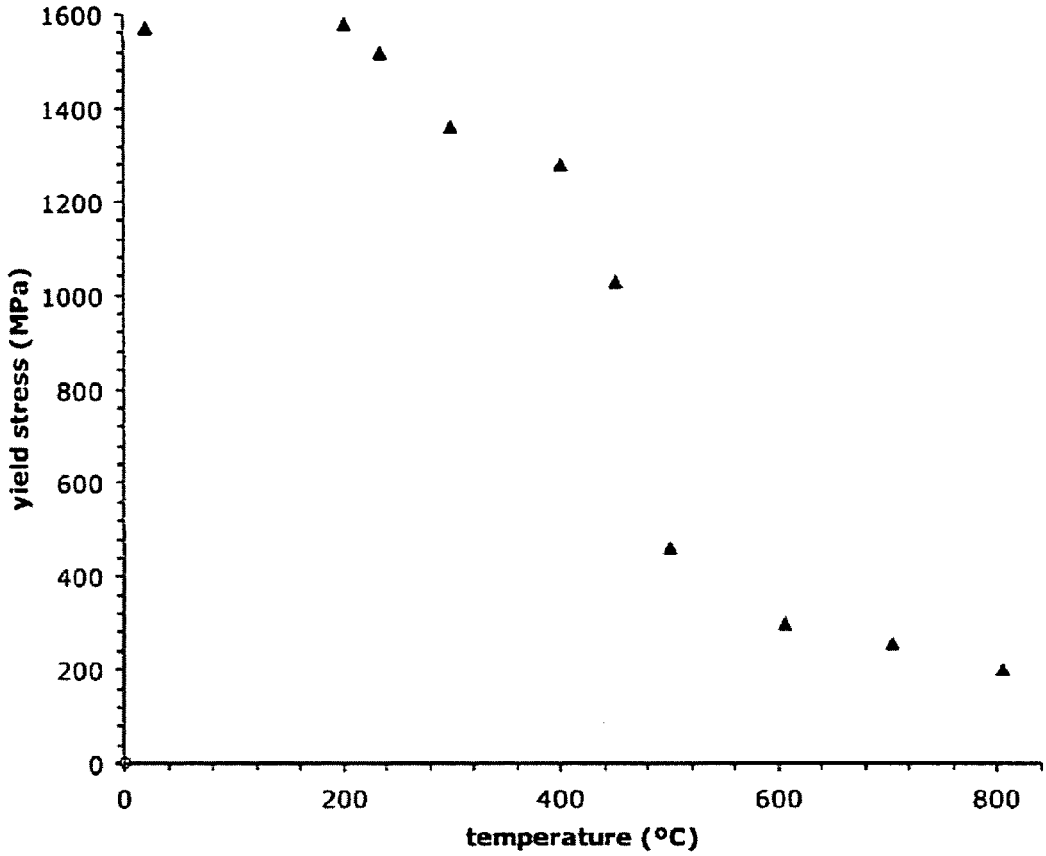
FIG. 3 is a plot showing yield stress versus temperature for $Fe_{30}Ni_{20}Mn_{25}Al_{25}$.

Yield strength of the alloy was determined using a MTS 810 mechanical testing system. The two phase alloy was subjected to mechanical testing at temperatures as shown in Table 3 and FIG. 3 and the yield strength was obtained. The yield strength at 294 K was determined to be 1570 MPa, and 1280 MPa at 673 K. The strength at temperature of the present alloy is higher than or comparable to the best current nickel-based superalloys, such as IN718, which contain many expensive elements and are difficult to process.

TABLE 3

Yield Strength Sensitivity to Temperature

| Temperature (K) | Yield Strength (MPa) |
|---|---|
| 294 | 1570 |
| 473 | 1580 |
| 508 | 1520 |
| 573 | 1360 |
| 673 | 1280 |
| 723 | 1030 |
| 773 | 460 |
| 878 | 300 |

TABLE 3-continued

Yield Strength Sensitivity to Temperature

| Temperature (K) | Yield Strength (MPa) |
|---|---|
| 978 | 255 |
| 1078 | 200 |

Figure 4:
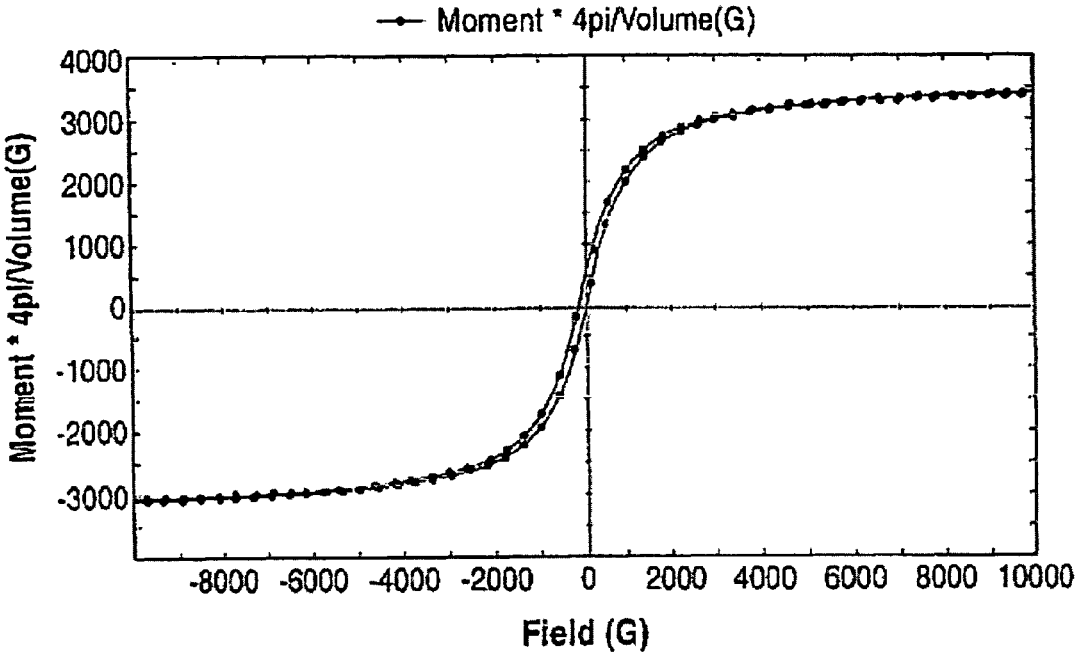
FIG. 4 is a magnetic hysteresis plot for the two phase alloy, $Fe_{30}Ni_{20}Mn_{25}Al_{25}$.

Magnetic studies were performed on 5-25 mg samples using a LakeShore Modle 668 VSM capable of measuring magnetic fields up to 1.4T. FIG. 4 is a representative hysteresis plot of the two phase alloy.

EXAMPLE 2

Preparation and Characterization of $Fe_xNi_{50-x}Mn_yAl_{50-y}$±5%

Various alloys have been cast with a composition:

$$Fe_xNi_{50-x}Mn_yAl_{50-y}, \qquad \text{Formula (2)}$$

wherein X ranges from 9 to 41, and

Y ranges from 9 to 41.

The alloys were cast using the aforementioned arc melting technique. Test results confirm that the miscibility gap forms over a large composition range, and that mechanical and magnetic properties can be manipulated by composition variations in this range. Table 4 lists the alloys evaluated and resulting magnetic and mechanical properties.

TABLE 4

Hardness, Magnetic Coercivity and Saturation Magnetization of Alloys

| Fe | Ni | Mn | Al | H (VPN) | Coer (G) | Sat. Mag (T) |
|---|---|---|---|---|---|---|
| 30 | 20 | 20 | 30 | 477 | 8.8 | 0.11 |
| 30 | 20 | 30 | 20 | 436 | 56.3 | 0.12 |
| 25 | 25 | 20 | 30 | 514 | 0.1 | 0.2 |
| 25 | 25 | 30 | 20 | 462 | 99 | 0.1 |
| 25 | 25 | 25 | 25 | 437 | 54 | 0.28 |
| 35 | 15 | 25 | 25 | 467 | 16 | 0.29 |
| 15 | 35 | 25 | 25 | 432 | 54 | 0.21 |

In the case of $Fe_{30}Ni_{20}Mn_{30}Al_{20}$ $T_m$ with respect to FIG. 1 was empirically determined to be 1544 K.

EXAMPLE 3

Characterization of Spinodal Phase Diagram

A spinodal phase diagram of the type shown as FIG. 1 may be constructed by varying percentages of Fe, Ni, Mn, Al and M as described in context of Formula (1), except the subscripts a, b, c, d, and e, may be any value. The constituents are processed as described in Examples 1 and 2 to ascertain the presence or absence of spinodal decomposition products, hardness, and magnetic moment. The preferred metals include combinations of Fe, Ni, Mn, and Al, in which case the ranges for X and Y shown in Formula (2) may be any value. When adjusting the respective subscripts a, b, c. d. e, X or Y, it is suggested to increase or decrease the individual ranges or combinations of ranges in steps of five percent from the values shown regarding Formula (1) and (2), at least until the resulting alloy does not show evidence of spinodal decomposition. It is also possible to repeat the study substituting Co for Ni, in whole or in part, to increase the magnetic moment. For alloys that contain four or five constituents, it is routine in the art that several hundred castings are needed to fully characterize the spinodal phase diagram.

EXAMPLE 4

Anneal and Hardness of $Fe_{30}Ni_{20}Mn_{25}Al_{25}$

Figure 5:
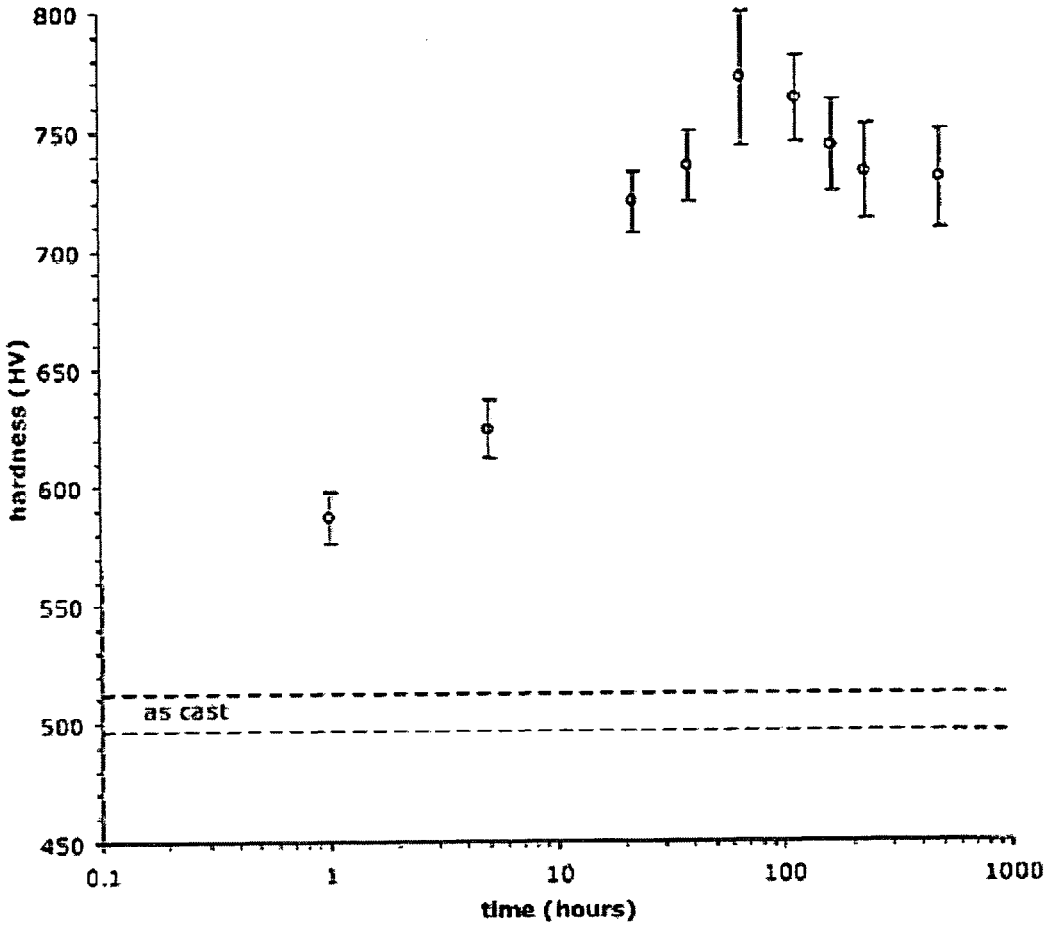
FIG. 5 is a plot showing hardness versus time of a 550° C. anneal for $Fe_{30}Ni_{20}Mn_{25}Al_{25}$.

A plurality of alloy ingots were prepared in an identical manner with respect to what is shown in Example 1. Following the quench, each ingot was placed in a oven and subjected to a 550° C. anneal in air. This temperature is within the spinodal temperature region, for example, as shown in FIG. 1. Duration of the anneal differed for each ingot as shown in Table 5. Following the anneal, the ingot was removed from the oven and permitted to cool to room temperature. A hardness test was performed on each ingot at room temperature to assess the effect of anneal upon material harness. The hardness results are shown in Table 5 and FIG. 5.

TABLE 5

Sensitivity of Hardness to Anneal Duration

| Duration of Anneal at 550° C. (Hours) | Hardness (hv) |
|---|---|
| 0 | 504 |
| 1 | 587 |
| 5 | 624 |
| 22 | 720 |
| 39 | 735 |
| 67 | 772 |
| 115 | 763 |
| 165 | 744 |
| 236 | 733 |
| 495 | 730 |

Yield strength tests were conducted on three samples annealed for 115 h. One sample showed yielding at 2350 MPa in compression with brittle fracture at 2480 MPa, while two other samples experienced brittle fracture at 2090 and 2110 MPa without obvious signs of macroyielding.

It is understood for purposes of this disclosure, that various changes and modifications may be made to the disclosed embodiments that are well within the scope of the invention. Numerous other changes may be made which will readily suggest themselves to those skilled in the art and which are encompassed in the spirit of the invention disclosed herein and as defined in the appended claims.

This specification contains numerous citations to references such as patents, patent applications, and publications. Each is hereby incorporated by reference for all purposes.

What is claimed is:

1. An intermetallic composition formed by spinodal decomposition in at least two distinct structural phases, each of said phases being quaternary, and the intermetallic composition having an average composition comprising from 9% to 41% iron, 9% to 41% nickel, 9% to 41% manganese and 9% to 41% aluminum, wherein the composition is described in terms of atomic percentages.

2. The intermetallic composition of claim 1, wherein the microscopic content varies with localized nanostructure.

3. The intermetallic composition of claim 1, wherein the composition comprises 30% iron, 20% nickel, 25% manganese and 25% aluminum.

4. The intermetallic composition of claim 3, wherein the composition comprises a yield strength of at least 1400 MPa at room temperature.

5. The intermetallic composition of claim 3, wherein the composition comprises a yield strength of at least 2000 MPa at room temperature.

6. The intermetallic composition of claim 1, further comprising a coating.

7. The intermetallic composition of claim 6, wherein the coating is selected from the group consisting of polymeric coatings, silicon-based coatings, metal oxide coatings, gold, platinum, silver, carbon-based coatings, adhesives, and combinations thereof.

8. An intermetallic composition formed by spinodal decomposition in at least two distinct body-centered cubic structural phases, each of said phases being quaternary, and the intermetallic composition having an average composition comprising from 9% to 41% iron, 9% to 41% nickel, 9% to 41% manganese and 9% to 41% aluminum, wherein the composition is described in terms of atomic percentages.

9. The intermetallic composition of claim 8, wherein the composition comprises 30% iron, 20% nickel, 25% manganese and 25% aluminum.

* * * * *

UNITED STATES PATENT AND TRADEMARK OFFICE

CERTIFICATE OF CORRECTION

PATENT NO. : 7,815,850 B2
APPLICATION NO. : 11/517036
DATED : October 19, 2010
INVENTOR(S) : Ian Baker et al.

It is certified that error appears in the above-identified patent and that said Letters Patent is hereby corrected as shown below:

Column 4, Line 64, "$Fe_3Ni_{34}Mn_{14}Al_{39}$" should read --$Fe_{13}Ni_{34}Mn_{14}Al_{39}$--;

Column 6, Line 12, "Modle" should read --Model--;

Signed and Sealed this
Eleventh Day of January, 2011

David J. Kappos

David J. Kappos
*Director of the United States Patent and Trademark Office*